US011192683B2

(12) United States Patent
Richter

(10) Patent No.: US 11,192,683 B2
(45) Date of Patent: Dec. 7, 2021

(54) DOUBLE BARREL FOR HAZARDOUS GOODS

(71) Applicant: Bodo Richter, Bad Honnef (DE)

(72) Inventor: Guenter Richter, Altenkirchen (DE)

(73) Assignee: Bodo Richter, Bad Honnef (DE)

( * ) Notice: Subject to any disclaimer, the term of this patent is extended or adjusted under 35 U.S.C. 154(b) by 338 days.

(21) Appl. No.: 16/479,817

(22) PCT Filed: Feb. 7, 2018

(86) PCT No.: PCT/EP2018/052993
§ 371 (c)(1),
(2) Date: Jul. 22, 2019

(87) PCT Pub. No.: WO2018/146115
PCT Pub. Date: Aug. 16, 2018

(65) Prior Publication Data

US 2020/0087027 A1 Mar. 19, 2020

(30) Foreign Application Priority Data

Feb. 9, 2017 (DE) ..... 202017100694.8

(51) Int. Cl.
*B65D 6/10* (2006.01)
*B65D 8/02* (2006.01)
*B65D 25/24* (2006.01)

(52) U.S. Cl.
CPC ..... *B65D 11/16* (2013.01); *B65D 11/08* (2013.01); *B65D 25/24* (2013.01)

(58) Field of Classification Search
CPC ..... B65D 11/16; B65D 11/08; B65D 25/24; B65D 25/16; B65D 11/06; B65D 1/20; B65D 1/16
(Continued)

(56) References Cited

U.S. PATENT DOCUMENTS 4,635,814 A * 1/1987 Jones ..... B65D 77/06 220/495.04
4,706,836 A * 11/1987 Greck ..... B65D 39/084 220/259.4
(Continued)

FOREIGN PATENT DOCUMENTS

CN 1164842 A 11/1997
CN 1732115 A 2/2006
(Continued)

OTHER PUBLICATIONS

English translation of International Search Report of PCT/EP2018/052993.
(Continued)

*Primary Examiner* — Anthony D Stashick
*Assistant Examiner* — Lauren Kmet
(74) *Attorney, Agent, or Firm* — Alexander R. Schlee; Pascal A. Schlee; Schlee IP International, PC

(57) ABSTRACT

A double barrel for hazardous goods with an outer barrel of plastic and an inner barrel of plastic received in the outer barrel. The body of the outer barrel is formed of a first barrel part and a second barrel part. The first barrel part has a first connecting area and the second barrel part has a second connecting area that is complementary to the first connecting area. The first and the second barrel part are firmly connected to each other via the connecting areas in an assembled state by means of a circumferential plastic weld seam.

10 Claims, 2 Drawing Sheets

(58) Field of Classification Search
USPC ..... 220/604
See application file for complete search history.

(56) References Cited

U.S. PATENT DOCUMENTS

| | | | | |
|---|---|---|---|---|
| 9,162,816 | B1 | 9/2015 | Hardy | |
| 2009/0269530 | A1* | 10/2009 | Schmidt | F42B 39/14 428/36.7 |
| 2019/0002155 | A1* | 1/2019 | Kelly | B67D 1/0805 |

FOREIGN PATENT DOCUMENTS

| | | | | |
|---|---|---|---|---|
| CN | 101622191 | A | 1/2010 | |
| CN | 101622191 | A | 1/2010 | |
| CN | 102133955 | A | 7/2011 | |
| EP | 0333544 | A1 | 9/1989 | |
| EP | 2896575 | A1 * | 7/2015 | B65D 25/24 |
| EP | 2896575 | A1 | 7/2015 | |

OTHER PUBLICATIONS

English Translation of Written Opinion of the ISA=EP in underlying PCT/EP2018/052993.

* cited by examiner

DOUBLE BARREL FOR HAZARDOUS GOODS

CROSS REFERENCE TO RELATED APPLICATION

This application is a national phase of the International Application PCT/EP2018/052993 filed Feb. 7, 2018, claiming priority of the German Patent Application DE 20 2017 100 694.8 filed Feb. 9, 2017. The content of this aforementioned document is herewith incorporated by reference.

BACKGROUND OF THE INVENTION

The invention relates to a double barrel for hazardous goods, comprising an outer barrel made of plastic and an inner barrel made of plastic received within the outer barrel.

Such a double barrel is known as a combination barrel from EP 2 896 575 A1 of the same applicant. This combination barrel has the advantage of a light weight, is simply structured and is easily producible by a blow-molding method. For hazardous goods, such as acids etc., such a barrel must present high stability for the transport and increased operational safety.

SUMMARY OF THE INVENTION

It is the object of the invention to specify a double barrel for hazardous goods which, while maintaining a simple structure, has a high stability and operational safety.

According to an aspect of the invention, the double barrel for hazardous goods comprises an outer barrel made of plastic and an inner barrel made of plastic and received in the outer barrel, wherein the body of the outer barrel is formed of a first barrel part and a second barrel part, the first barrel part has a first connecting area and the second barrel part has a second connecting area complementary to the first connecting area, and the first and the second barrel part are firmly connected to each other via the connecting areas in an assembled state by means of a circumferential plastic weld seam.

DETAILED DESCRIPTION OF THE INVENTION

According to one development, in this double barrel the wall of the outer barrel in the area of the circumferential plastic weld seam is thicker by the factor of 1.5 to 2.0 than the wall thickness of the outer barrel in the middle area of the height of the outer barrel in an upright condition. With the aid of this constructive measure, the ring-shaped weld surface is considerably increased, and the stability of the body of the outer barrel assembled from the first barrel part and the second barrel part is increased. In this way, forces which are obliquely incident on the upper second barrel part are reliably absorbed and a breaking of the outer barrel can be prevented even in the case of high forces. The thickening at the connecting areas of the weld seam preferably exclusively projects inwardly so that the outer shape of the double barrel does not show the thickening. This is advantageous for the handling of the double barrel.

One development is characterized in that the weld seam produced by fusion welding is arranged as close as possible to an upper bottom of the second barrel part, preferably at a distance of 2 to 3 times the wall thickness of the upper bottom. In this area, near the upper bottom, the body of the outer barrel is particularly stable so that only low bending and shearing forces act on the weld seam, as a result whereof the risk of a breaking of the weld seam is reduced.

Another development provides that around at least one container opening in the upper bottom of the second barrel part, an elastic annular disk is arranged between the underside of the upper bottom and the upper side of the inner barrel. This elastic annular disk elastically absorbs forces which may act on this sensitive connecting area between upper bottom and upper side of the inner barrel. Preferably, this annular disk is made of an elastic foam material so that during pouring possibly spilled liquid residues are absorbed.

One advantageous development provides that a nozzle of at least one container opening of the inner barrel is firmly connected to the upper bottom of the outer barrel with the aid of a fixing ring. In this way, the inner barrel is fixed to the outer barrel, as a result whereof the entire double barrel gains stability. Preferably, two container openings are formed on the inner barrel and, correspondingly, the associated nozzles are fixed with one fixing ring each so that, as a consequence of the symmetric structure, forces acting thereon are symmetrically distributed.

It is advantageous when in the case of the fixed connection of the inner barrel with the upper bottom of the outer barrel, in the empty state of the inner barrel, a lower bottom of the inner barrel is held at a predetermined distance to a lower bottom of the outer barrel, preferably 2 to 3 times the wall thickness of the lower bottom of the inner barrel. Given this constructive design, an air envelope of the type of an air cushion is present between the inner surface of the outer barrel and the outer surface of the inner barrel. In the case of a sudden impact on the outer barrel, the impact force is absorbed by displacement of the air, as a result whereof the inner barrel is protected.

Another advantageous measure provides that the outer dimension of the inner barrel in the middle area of the circumferential surface is smaller by an amount corresponding to 0.8 to 1.2 times the wall thickness of the outer barrel than the inner dimension of the outer barrel in this area. This also results in a coat-like air envelope which upon sudden impacts onto the circumferential surface of the outer barrel is absorbed by the air in the air envelope.

It is advantageous when the wall thickness of the inner barrel amounts to at least 2 mm in the middle area of the circumferential area of the inner barrel, given a volume of about 200 l of the inner barrel. In this way, a stable but nevertheless lightweight construction is achieved.

Another embodiment is characterized in that the wall thickness of the inner barrel, when in an upright position, tapers from top to bottom in the area of its circumferential surface uniformly in the ratio of 2.5 through 1.8 to 1. By way of this measure, on the one hand, in the upper area of the double barrel an improved stability is achieved and, on the other hand, plastic material is saved by the tapering, which reduces the material consumption and increases economic efficiency.

Another development is characterized in that the ratio of the wall thickness of outer barrel to the wall thickness of the inner barrel at the middle height of the double barrel lies in the range from 2.7 through 2.3 to 1, given an otherwise constant wall thickness of the outer barrel in the middle area of its circumferential surface. With the aid of this constructive measure, on the one hand, by the outer circumferential surface of the outer barrel a high protection for the inner barrel and at the same time a low plastic material consumption is achieved.

BRIEF DESCRIPTION OF THE DRAWINGS

An embodiment of the invention is explained in the following on the basis of the Figures.

DETAILED DESCRIPTION OF THE DRAWINGS

Figure 1:
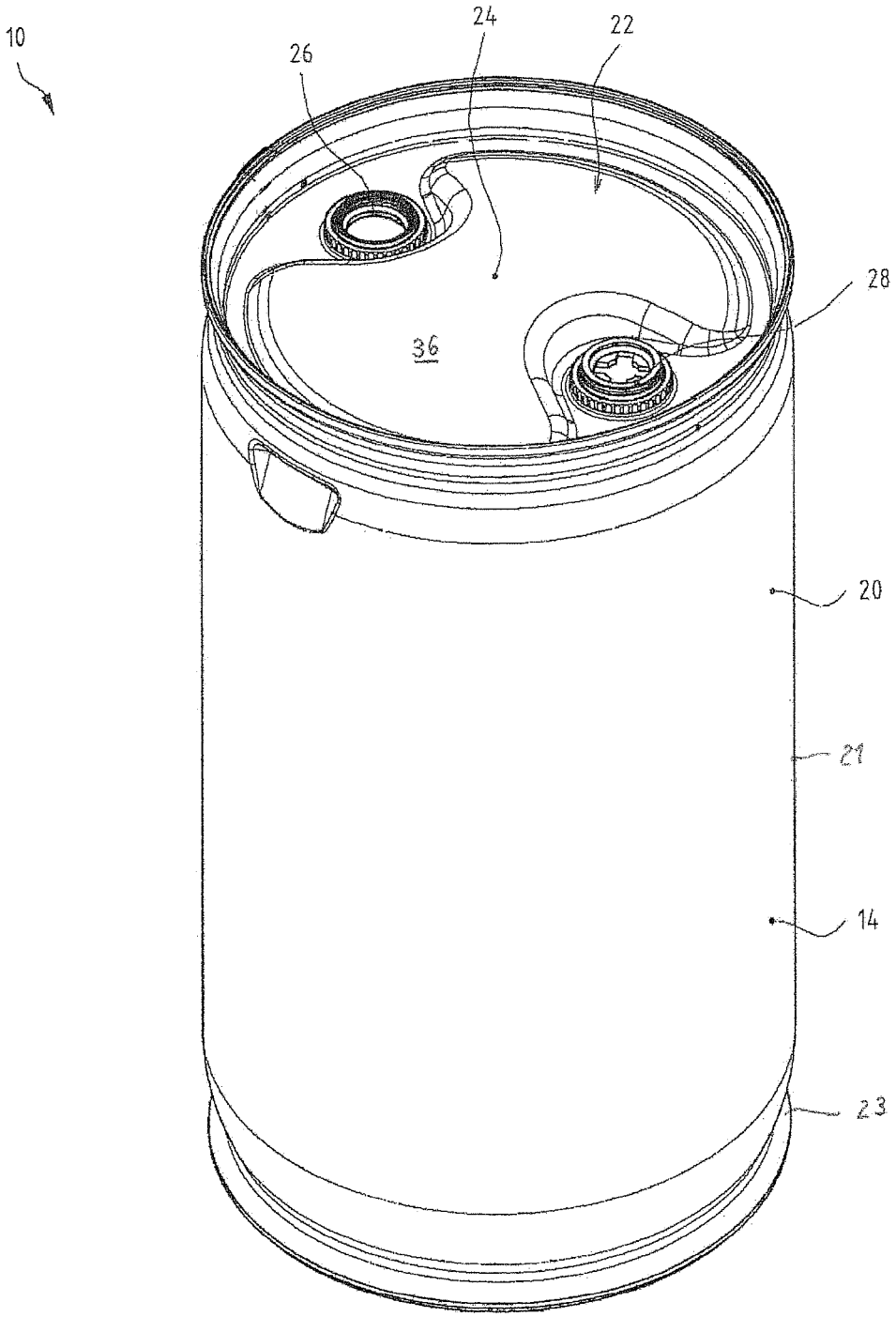
FIG. 1 shows a schematic perspective illustration of a double barrel.

FIG. 1 shows in a perspective illustration, an embodiment of the double barrel. This double barrel is a development of the combination barrel described in EP 2 896 575 A1 of the same applicant. Reference is made to this patent application in particular with respect to the production method according to the plastic blow molding method.

The double barrel 10 shown in FIG. 1 comprises a plastic outer barrel 14 in which an inner barrel 12 (see FIG. 2) is received in an almost flush manner. This outer barrel 14 is made up of a first barrel part 20 having a circumferential surface 21 that is almost cylindrical over the largest part of its length and a bottom part 23, and a second barrel part 22, which is placed on the first barrel part 20 and welded thereto. In this second barrel part 22, which forms the cover of the double barrel 10, a ventilation valve 24 as well as fill-in openings 26, 28 are provided, which go through an upper bottom 36 in the second barrel part 22. Preferably, polyethylene is used as a plastic material for the outer barrel 14 and the inner barrel 12.

Figure 2:
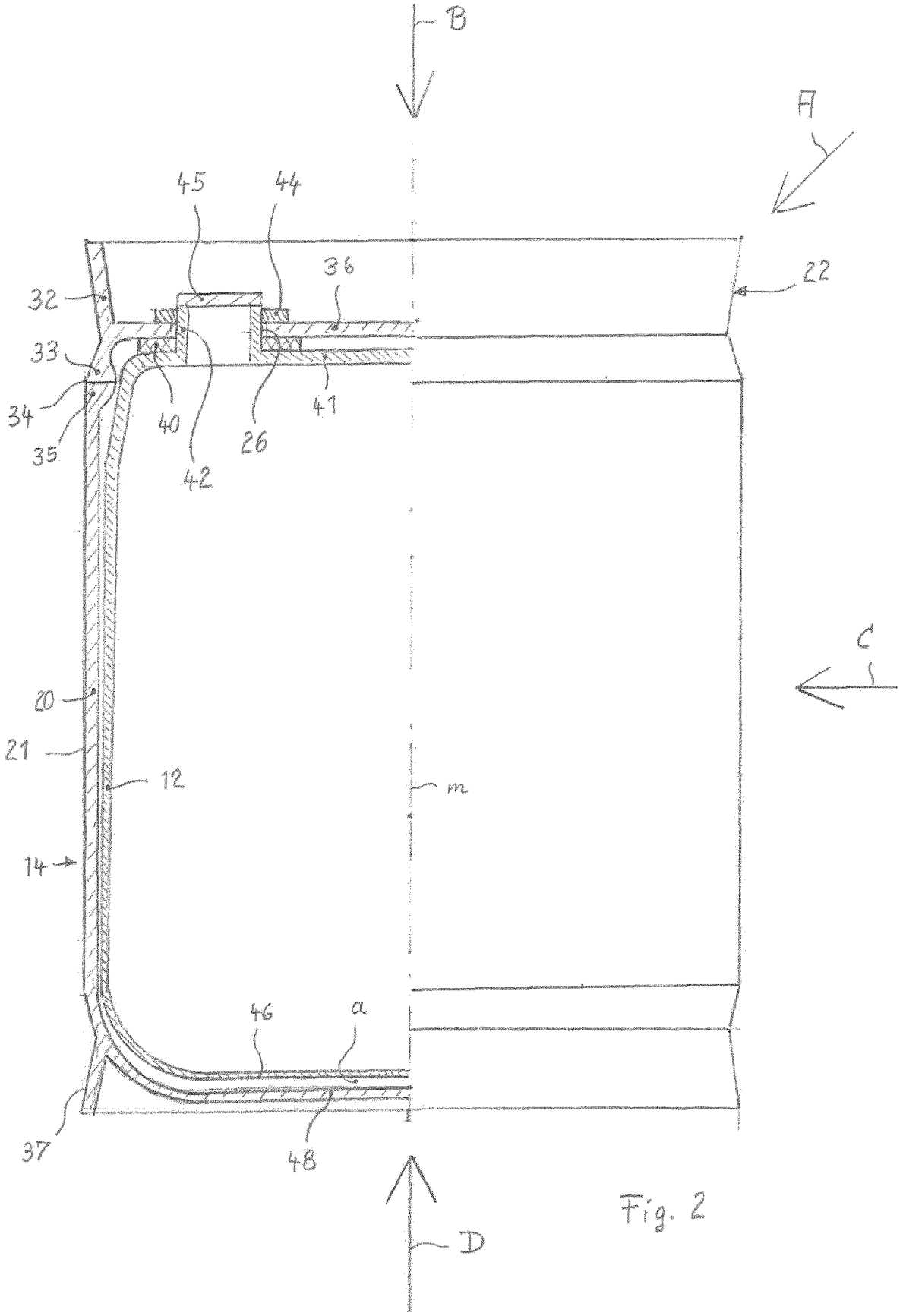
FIG. 2 shows a partial sectional view of the double barrel.

FIG. 2 shows a partial sectional view of the double barrel 10 partially cut along a symmetrical line m. As described further above, the inner barrel 12 is received in the outer barrel 14. The outer barrel 14 is made up of the first barrel part 20 and the second barrel part 22, which are connected to each other with respective connecting areas 33, 35 at a weld joint 34 by fusion welding, also referred to as mirror welding. In the lower portion of the first barrel part 20, a standing rim 37 is formed. The second barrel part 22 comprises an upper stacking rim 32 into which the standing rim 37 of a further double barrel may be received for stacking. During transport or handling, considerable forces, entered as arrows A, B, C, D in FIG. 1, may act on the double barrel 10. The double barrel 10 is characterized by a high stability and a high operational safety, for which various technical measures have been taken. When a force acts in the direction of the arrow A, i.e. in a direction diagonally to the double barrel 10 and in a direction onto the stacking rim 32, the latter may deform and considerable forces occur at the circumferential weld joint 34, by which a breaking may occur at this weld joint 34.

To prevent such a breaking, in the area of the circumferential weld joint 34 the connecting areas 33, 35 of the outer barrel 14 are thicker by approximately the factor 1.5 to 2.0 than the usual wall thickness of the outer barrel 14 approximately in the middle of the height of the outer barrel 14. Typically, the wall thickness of the outer barrel amounts to 4 to 5 mm thereat. By the material thickening in the area of the weld joint 34, the ring-shaped weld surface is considerably increased and the risk of a breaking is reduced also in the case of high forces in the direction of the arrow A. Further, it is advantageous when this weld joint 34 is formed as close as possible to the upper bottom 36 of the second barrel part 22, preferably at a distance of 2 to 3 times the wall thickness of the upper bottom 36 which typically amounts to 4 to 5 mm. In this area near the upper bottom 36 and the stacking rim 32, the outer barrel 14 is particularly mechanically stable, as a result whereof a weld seam arranged thereat may absorb relatively high forces.

Around the container opening 26 an elastic annular disk 40 is arranged between the upper bottom 36 and an upper side 41 of the inner barrel 12. This elastic annular disk 40 is preferably made of foam material, as a result whereof it gets its elasticity. This elastic annular disk 40 may in particular absorb forces in the direction of the arrow B so that external forces are not readily transmitted directly via the upper side 41 onto the inner barrel 12. In the embodiment with foam material, this annular disk 40 may in addition absorb spilled liquid residues and in this way keep the interior between the inner barrel 12 and outer barrel 14 dry.

On the inner barrel 12, in the area of the container opening 26 a nozzle 42 is formed which goes through the upper bottom 36 and is firmly connected to the upper bottom 36 by means of a fixing ring 44. By way of this fixation of the inner barrel 12 to the upper bottom 36, preferably by a screw connection, preferably by interaction with the elastic annular disk 40 an improved stability against forces acting in the direction of the arrow B is achieved. As can be seen in FIG. 1, two container openings 26, 28 are formed, as a result whereof a symmetrical structure is given and forces acting thereon are symmetrically distributed. The nozzle 42 is closeable by a plug 45.

Given this firm connection of the inner barrel 12 with the upper bottom 36, it is advantageous when in the empty state of the inner barrel 12 a lower bottom 46 of the inner barrel 12 is kept at a predetermined distance a to a lower bottom 48 of the outer barrel 14. This distance a should be in the range of 2 to 3 times the wall thickness of the lower bottom 46 of the inner barrel 12. In this way, an air envelope of the type of an air cushion is present between inner barrel 12 and outer barrel 14. In the case of a sudden force impact in the direction B or in the direction D, e.g. by an impact or a shock, the air in this air cushion is displaced and thus the impact force is absorbed, as a result whereof the inner barrel 12 is protected. Also in the area of the circumferential surface 21 of the double barrel 10 measures for creating an air cushion may be taken. The outer dimension of the inner barrel 12 in the area of the circumferential surface 21 of the double barrel 10 is smaller by an amount corresponding to 0.8 to 1.2 times the wall thickness of the outer barrel 14 than the inner dimension of the outer barrel 14 in this area. The resulting air cushion causes in the case of a force impact in the direction C that air is displaced and thus the inner barrel 12 is protected. The ring-shaped air-filled intermediate space formed by the constructive measures acts like an air cushion with valve and damps shock-like forces. The so-defined outer dimension of the inner container interacts advantageously with the wall thickening at the weld seam and facilitates the insertion of the inner container into the outer container.

A further measure is characterized in that the wall thickness of the inner barrel 12, when in an upright position, tapers from top to bottom in the area of the circumferential surface 21 of the double barrel 10 uniformly in the ratio of 2.5 through 1.8 to 1. In the upper area, thus the stability of the inner barrel 12 is improved and as a result of the tapering plastic material may be saved.

The wall thickness of the outer barrel 14 at the height of the middle of the double barrel 10 is typically in the range from 4 to 5 mm and is almost constant in the area of the circumferential surface 21. The ratio of the wall thickness of the outer barrel 14 to the wall thickness of the inner barrel 12 at the height of the middle of the double barrel 10 lies in the range from 2.7 through 2.3 to 1.

In case experiments with filled inner container, said measures have proven effective both alone and in combination, and a high operational safety of the double barrel could be proven.

Preferably, the double barrel 10 is produced by a plastic blow molding process. In one single working step, the outer barrel 14 is formed from a plastic hose, wherein the material thickening at the connecting areas 33, 35 is formed during the controlled formation of the upper bottom 36. The closed outer barrel 14 is then separated along the later weld joint 34 and the inner barrel 12, likewise produced by blow molding, is inserted. By means of a welding mirror, the weld surfaces of the connecting areas 33, 35 are molten, the welding mirror is removed and the first barrel part 20 is permanently connected to the second barrel part 22.

LIST OF REFERENCE SIGNS

10 double barrel
12 inner barrel
14 outer barrel
20 first barrel part
21 circumferential surface
22 second barrel part
23 bottom part
24 ventilation valve
26, 28 filling openings
33, 35 connecting areas
34 weld joint
32 upper stacking rim
37 standing rim
A, B, C, D force directions
36 upper bottom
40 annular disk
42 nozzle
44 fixing ring
46 lower bottom of the inner barrel
48 lower bottom of the outer barrel
a distance
45 plug

What is claimed is:

1. A double barrel for hazardous goods, comprising:

an outer barrel made of plastic and an inner barrel made of plastic and received in the outer barrel, wherein the body of the outer barrel is formed of a first barrel part and a second barrel part, the first barrel part has a first connecting area and the second barrel part has a second connecting area complementary to the first connecting area, and the first and the second barrel part are firmly connected to each other via the connecting areas in an assembled state by means of a circumferential plastic weld seam;

wherein each of the connecting areas are formed thicker in the area of the circumferential plastic weld seam by the factor 1.5 to 2.0 than the wall thickness of the outer barrel in the middle of the height of the outer barrel, and wherein the wall thickness of the inner barrel in an upright position tapers from top to bottom in the area of its circumferential surface uniformly in the ratio of 2.5 through 1.8 to 1.

2. The double barrel according to claim 1, wherein the weld seam produced by fusion welding is arranged as close as possible to an upper bottom of the second barrel part, namely at a distance of 2 to 3 times the wall thickness of the upper bottom.

3. The double barrel according to claim 1, wherein around at least one container opening in an upper bottom of the second barrel part an elastic annular disk is arranged between the underside of the upper bottom and the upper side of the inner barrel.

4. The double barrel according to claim 1, wherein a nozzle of at least one container opening of the inner barrel is connected by means of a fixing ring firmly with an upper bottom of the outer barrel.

5. The double barrel according to claim 4, wherein given the firm connection of the inner barrel with the upper bottom of the outer barrel in the empty state of the inner barrel a lower bottom of the inner barrel is kept at a predetermined distance (a) to a lower bottom of the outer barrel, namely 2 to 3 times the wall thickness of the lower bottom of the inner barrel.

6. The double barrel according to claim 1, wherein the outer diameter of the inner barrel in the area of the circumferential surface of the double barrel is 0.8 to 1.2 times the wall thickness of the outer barrel taken away from the inner diameter of the outer barrel in this area.

7. The double barrel according to claim 1, wherein the wall thickness of the inner barrel in the middle area of the circumferential surface of the inner barrel amounts to at least 2 mm.

8. The double barrel according to claim 1, wherein the ratio of the wall thickness of the outer barrel to the wall thickness of the inner barrel at the height of the middle of the double barrel lies in the range of 2.7 through 2.3 to 1 given an otherwise constant wall thickness of the outer barrel in the middle area of its circumferential surface.

9. The double barrel according to claim 1, wherein the inner barrel has a volume of 180 to 220 l.

10. The double barrel according to claim 1, wherein it is produced by a plastic blow molding method.

* * * * *